United States Patent [19]

Inagaki et al.

[11] 4,115,030

[45] Sep. 19, 1978

[54] ELECTRIC MOTOR OR GENERATOR INCLUDING CENTRIFUGAL COOLING FAN

[75] Inventors: Mitsuo Inagaki; Hideaki Sasaya; Takashi Kurahashi, all of Okazaki, Japan

[73] Assignee: Nippon Soken, Inc., Nishio, Japan

[21] Appl. No.: 769,782

[22] Filed: Feb. 17, 1977

[30] Foreign Application Priority Data

Feb. 20, 1976 [JP] Japan ..... 51-18228

[51] Int. Cl.[2] ..... F01D 5/00

[52] U.S. Cl. ..... 416/93 R; 416/185; 416/DIG. 3; 310/51; 310/62; 415/119

[58] Field of Search ..... 310/62, 63, 51, 58, 310/59, 60, 65; 415/119; 416/DIG. 3, 60, 185, 93, 214, 500; 417/368

[56] References Cited

U.S. PATENT DOCUMENTS

| | | | |
|---|---|---|---|
| 2,032,552 | 3/1936 | Seyfried | 310/62 |
| 2,512,905 | 6/1950 | Willits | 310/62 |
| 3,252,025 | 5/1966 | Brown | 310/51 |
| 3,367,687 | 2/1968 | Jenkins | 310/60 |
| 3,534,204 | 10/1970 | Groezinger | 310/62 |

FOREIGN PATENT DOCUMENTS

| | | | |
|---|---|---|---|
| 1,275,916 | 6/1972 | United Kingdom | 310/62 |

*Primary Examiner*—R. Skudy

*Attorney, Agent, or Firm*—Cushman, Darby & Cushman

[57] ABSTRACT

A rotary electric machine comprising a housing containing therein several parts which are to be heated during operation of the machine, and a centrifugal cooling fan for producing an air circulation through the housing so as to cool the heated parts. The cooling fan is made of a disc-shaped metal plate having on its periphery a plurality of fan blades each formed by bending a radially outer portion of the metal plate upstandingly with respect to the surface thereof, and a plurality of notches each defined between the adjacent fan blades. A backing disc-plate is disposed at the back side of the cooling fan in a manner to block therewith the notches, thereby preventing an air from passing through the notches in an opposite direction from an ordinary air flow passing through the housing. The disc-plate and the cooling fan are disposed to define a small clearance therebetween for preventing rattling noises from being produced during rotation of the cooling fan due to an occasional vibratory contact therebetween.

7 Claims, 4 Drawing Figures

ELECTRIC MOTOR OR GENERATOR INCLUDING CENTRIFUGAL COOLING FAN

BACKGROUND OF THE INVENTION

The present invention relates to a rotary electric machine, and more particularly to a rotary electric machine including a centrifugal cooling fan which is used as, for example, an electric motor and a power generator mounted on vehicles.

Heretofore, there has been known a rotary electric mahine comprising a housing having front and rear end walls, a rotary shaft operatively connected with a driving pulley and rotatably supported by the housing, and a cooling fan having on its periphery a plurality of or a series of fan blades. The end walls of the housing is formed therein with a plurality of air vents for producing an air circulation through the housing during rotation of the cooling fan, so as to cool heated parts such as a stator and a rotor housed in the housing. The cooling fan includs a disc-shaped metal plate having on its periphery a plurality of substantially radially extending and circumferentially spaced fan blades each formed by bending a radially outer portion of the metal plate upstandingly with respect to the surface of the metal plate. Further, with the structure of the cooling fan described, a plurality of notches are defined between the adjacent fan blades. In other words, the cooling fan has on its periphery the plurality of fan blades and notches alternately in a zigzag fashion. However, during rotation of the cooling fan of the structure described, there occurs an air flow passing through the notches oppositely to an ordinary air flow passing through the housing, which makes the cooling efficiency inferior and causes large noises.

In order to cope with the above problem, it has been proposed to attach by spot welding or the like a backing disc-plate on a back surface of the cooling fan, or the surface of the cooling fan opposite to the fan blades, in a manner to block or cover therewith the notches and thus preventing an air from passing therethrough. However, according to a series of experiments conducted by the inventors, it was found that the cooling fan thus improved suffered from a disadvantage such that there produced rattling noises by occasional vibratory contact between the cooling fan and the disc plate, particularly during an abrupt acceleration or deceleration of vehicles on which the rotary electric machine is moutned. The rattling noises are considered to occur due to a close face-to-face location of the disc-plate and the cooling fan, since it is technically difficult to attach the disc-plate on the back surface of the cooling fan in a uniformly contacted manner.

Also the improved cooling fan described suffered from an increased production cost, since the disc-plate, which is an additional member of the cooling fan, must be securely attached onto the cooling fan before it is assembled in the rotary electric machine.

SUMMARY OF THE INVENTION

It would be quite advantageous to give practical means to obviate the disadvantages encountered with the prior art structure described.

It is therefore a primary object of the present invention to provide a rotary electric machine of the type described, which is operable with high cooling efficiency and low noises.

It is another object of the invention to provide a rotary electric machine including a centrifugal cooling fan, which is mounted on vehicles and does not produce substantial rattling noises during abrupt acceleration or deceleration of the vehicles.

It is further object of the invention to provide a rotary electric machine including a centrifugal cooling fan of simple construction which can be manufactured with low cost.

In accordance with the present invention, there is provided a rotary electric machine comprising a housing having end wall means formed therein with a plurality of air vents for providing communication between an interior and an exterior of the housing, a rotary shaft rotatably supported by the housing, a cooling fan securely fitted on the rotary shaft and made of a plate material having on its periphery a plurality of fan blades each formed by bending a radially outer portion of the plate material and notches each defined between the adjacent fan blades, a backing disc-plate fixed at the back side of the cooling fan in a manner to block the notches, and means for defining a small clearance between the disc-plate and the cooling fan.

The foregoing objects and other objects as well as the characteristic features of the invention will become more apparent and more readily understandable by the following description and the appended claims when read in conjunction with the accompanying drawings.

BRIEF DESCRIPTION OF THE DRAWINGS

In all Figures, the same or similar parts are indicated by the same or similar numerals.

DETAILED DESCRIPTION OF THE PREFERRED EMBODIMENT

Figure 1:
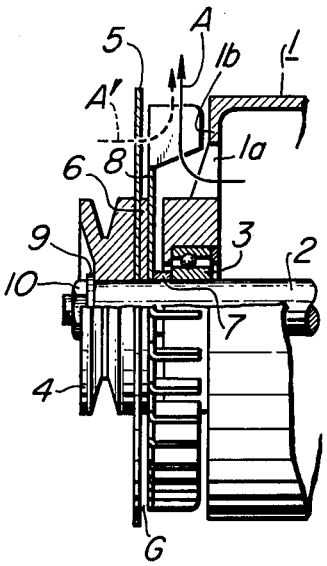
FIG. 1 is a fragmentary side elevational view showing, partly in cross-section, a rotary electric machine of a first embodiment according to the present invention.
Figure 2:
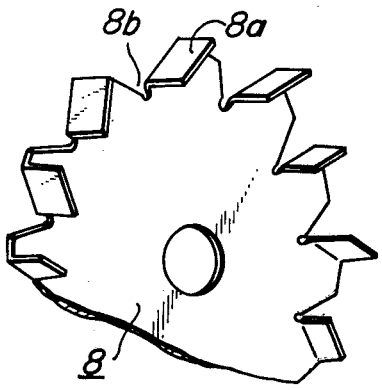
FIG. 2 is a fragmentary perspective view of a centrifugal cooling fan incorporated in the rotary electric machine shown in FIG. 1.

First Embodiment (FIGS. 1 and 2)

Referring first to FIG. 1, a rotary electric machine of a first embodiment according to the present invention includes a housing 1 adapted to house therein several parts such as a stator and a rotor (not shown) of the rotary electric machine. The housing has front and rear end walls each formed therein with a plurality of air vents (Only the front end wall 1b and the air vents 1a formed therein are illustrated). A rotary shaft 2 is rotatably supported by the housing 1 through a bearing 3. A spacer 7, a cooling fan 8, a spacer 6, a backing disc-plate 5 and a driving pulley 4 are successively fitted on the rotary shaft 2, and fixed together thereon by means of a nut 10, through a washer 9.

The cooling fan 8 is formed of a metal plate. More particularly, the cooling fan 8 has on its periphery a plurality of substantially radially extending and circumferentially spaced fan blades **8*a* each formed by bending a radially outer portion of the metal plate upstandingly with respect to the surface thereof, as will be understood from FIG. 2. Since the fan blades 8*a* are formed in the manner described, a plurality of notches 8*b* are defined between the adjacent fan blades 8***a*. Thus, the cooling fan 8 shown in FIG. 2 includes on its periphery the plurality of fan blades 8*a* and notches 8*b* formed alternately in a zigzag fashion. The cooling fan 8 is fitted and fixed on the rotary shaft 2 with the fan blades 8*a* thereof opposed to the housing 1.

The disc-plate 5 is formed of a plate material such as a metal plate and a plastic plate, and is disposed at the back side of the cooling fan 8, i.e., at that side of the cooling fan to which the fan blades 8*a* are not projecting, in a manner to block or cover therewith the notches 8*b* of the cooling fan 8. The disc-plate 5 and the cooling fan 8 are arranged in an opposed relation with the spacer 6 interposed therebetween, so as to define a positive clearance G at a radially outer portion between the disc-plate 5 and the cooling fan 8. In the illustrated embodiment, the disc-plate 5 has a substantially larger diameter than an outer diameter of the cooling fan 8. The driving pulley 4 is adapted to be driven by suitable power sources such as an engine (not shown), through a driving belt (not shown) wound therearound.

Next, the operation of the rotary electric machine shown in FIGS. 1 and 2 will be described.

When the driving pulley 4 is supplied with a driving power and thus rotated, also the rotary shaft 2, the disc-plate 5, the spacers 6 and 7, and the cooling fan 8 are rotated. During rotation of the cooling fan 8, there is induced or sucked an air from the outside of the housing 1 into the inside thereof through the air vents formed in the rear end wall (not shown) of the housing 1, due to centrifugal air-inducing action of the cooling fan 8. The air thus induced into the housing 1 flows through the housing while cooling the heated parts such as the stator and the rotor (not shown) housed in the housing 1, and in turn flows out of the housing 1 through the air vents 1a in the front end wall 1b thereof.

With the structure of the invention in which the disc-plate 5 is disposed at the back side of the cooling fan 8 in the manner described, it is possible to effectively shut off an air flow which is otherwise induced in an axial direction from outside or left side of the disc-plate 5 to inside or right side of the cooling fan 8 as shown by a phantom arrow A' in FIG. 1, thereby preventing turbulence flows of air from occurring. Consequently, the air having passed through the housing 1 and induced out of the air vents 1a flows uniformly and smoothly along the fan blades 8a in a radially outward direction as shown by a full line arrow A in FIG. 1.

By virtue of the structural feature of the invention in which the smooth and uniform air flow as shown by the arrow A can be produced, it is possible to achieve an increased air flow rate due to an appreciable reduction in the flow resistance. Further, because of the prevention of the air flow shown by the phantom arrow A', low noise operation can be achieved. Furthermore, since the disc-plate 5 and the cooling fan 8 are disposed to define the positive clearance G therebetween, it is possible to prevent, during rotation of the cooling fan 8, occasional vibratory contact between the disc-plate 5 and the cooling fan 8, thereby preventing rattling noises from being produced.

It will be understood that the width of the clearance G is selected within a range in which turbulence air flows are not produced between the disc-plate 5 and the cooling fan 8. Generally, the width of the clearance G may take a value of a few millimeters, and preferably 1 to 3 millimeters. However, it may be varied from the above value depending upon the diameters of the disc-plate 5 the cooling fan 8.

Figure 3:
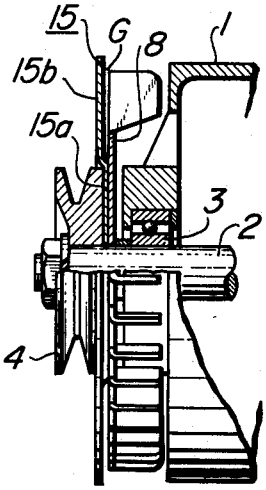
FIGS. 3 and 4 are fragmentary side elevational views similar to FIG. 1, showing rotary electric machines according to a second and a third embodiments, respectively, of the invention.
Figure 4:
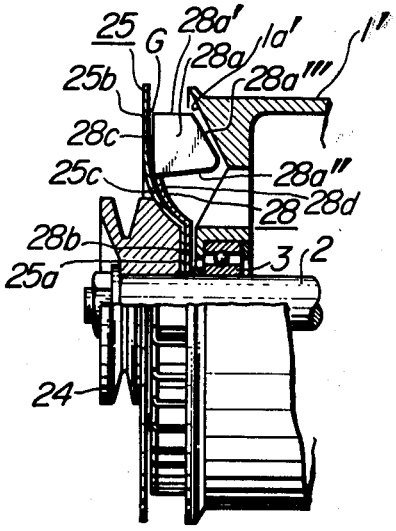

Second and Third Embodiments (FIGS. 3 and 4)

FIGS. 3 and 4 illustrate a second and a third embodiments of the present invention. In the second embodiment shown in FIG. 3, a backing disc-plate 15 has a radially outward flat portion 15*b* and a flat central portion 15*a* offset from the outward portion 15*b* toward the cooling fan 8. The offset central portion 15*a* has an inner or a right surface contacting the back surface of the cooling fan, in a manner to define the positive clearance G at a radially outer portion between the disc-plate 5 and the cooling fan 8. With this structure, it is possible to eliminate the spacer 6 of the first embodiment. The other structure of the second embodiment is substantially similar to that of the first embodiment.

In the third embodiment shown in FIG. 4, a cooling fan 28 has a radially outward flat portion 28*c*, a flat central portion 28*b* offset from the outward portion 28*c* toward a housing 1' and a transient portion 28*d* curved concavely from an axial direction to a radial direction when viewed in a direction of an air flow passing through the housing 1'. Also a backing disc-plate 25 has a radially outward flat portion 25*b*, a flat central portion 25*a* offset from the outward portion 25*b* toward the cooling fan 28 and a transient portion 25*c* curved concavely from an axial direction to a radial direction when viewed in the direction of the air flow passing through the housing 1'. The central and the transient portions 25*a* and 25*c* of the disc-plate 25 are closely contacting the central and the transient portions 28*b* and 28*d*, respectively, of the cooling fan 28 in a manner to define the positive clearance G at a radially outer portion between the disc-plate 25 and the cooling fan 28. A driving pulley 24 has a right side end closely engaging the central and the transient portions 25*a* and 25*c* of the disc-plate 25. Each fan blade 28*a* of the cooling fan 28 has a width gradually radially reduced from an inner edge 28*a''* to an outer edge 28*a'* thereof in a manner to provide a tapered side edge 28*a'''* opposed to the housing 1'. The surface 1*a'* of the housing 1' opposed to the side edge 28*a'''* is tapered so that it may become substantially parallel to the latter side edge 28*a'''*, and this tapered surface 1*a'* of the housing 1' has an outer diameter substantially identical with an outer diameter of the disc-plate 25. The other structure of the third embodiment is substantially similar to that of the first embodiment.

The third embodiment described has an advantage such that the spacer 6 of the first embodiment can be eliminated, as is similar to the second embodiment. Further, an air induced out of the housing 1' may flow uniformly and smoothly along the curved transient portion 28*d* of the cooling fan 28, and in turn along the fan blades 28*a* thereof. Consequently, the cooling efficiency can be further improved.

As fully described hereinbefore, the present invention provides an improved rotary electric machine which is operable with high cooling efficiency and low noises irrespective of its simple construction.

Although detailed description has been made exclusively on the typical embodiments of the invention, it should be understood that the preferred embodiments of the invention as described and shown herein do not mean in any way limitation of the invention thereto, but on the contrary many changes, variations and modifications with respect to the construction and arrangement in practice thereof may further be derived by those skilled in the art to which the present invention pertains.

What is claimed is:

1. A rotary electric machine comprising:

a housing having end wall means formed therein with a plurality of air vents for providing communication between an interior and an exterior of said housing;

a rotary shaft rotatably supported by said housing;

a cooling fan securely fitted on said rotary shaft for rotation therewith;

said cooling fan having on its periphery means providing a plurality of fan blades, notches between said fan blades, and a backing disc-plate having a portion covering said notches and fixed at the back side of said cooling fan for rotation therewith, with a clearance defined between said disc-plate and said cooling fan for preventing vibratory contact between said disc-plate and said cooling fan, said clearance being selected within the range in which turbulence air flows are not produced.

2. A rotary electric machine as defined in claim 1, further comprising a spacer securely fitted on said rotary shaft between said disc-plate and said cooling fan.

3. A rotary electric machine as defined in claim 1, wherein said clearance defining means is within the range from 1 to 3 millimeters.

4. A rotary electric machine as defined in claim 1, wherein said disc-plate has an outer diameter substantially larger than an outer diameter of said cooling fan.

5. A rotary electric machine as defined in claim 1, wherein said disc-plate includes a flat central portion offset toward and contacting the back surface of said cooling fan, said offset central portion of said disc-plate providing said clearance.

6. A rotary electric machine as defined in claim 1, wherein said cooling fan has a radially outward flat portion, a flat central portion offset from said outward flat portion toward said housing and a transient portion curved concavely from an axial direction to a radial direction when viewed in a direction of an air flow passing through said housing, each of said fan blades has a width gradually radially reduced from an inner edge to an outer edge thereof in a manner to provide a tapered side edge opposed to said housing, and said housing has a surface opposite to said fan blades which is tapered substantially parallel to said side edge of each of said fan blades.

7. A rotary electric machine as defined in claim 6, wherein said disc-plate includes a radially outward flat portion, a flat central portion offset toward said cooling fan and a transient curved concavely from an axial direction to a radial direction when viewed in the direction of the air flow passing through said housing, said central and transient portions of said disc-plate closely contacting said central and transient portions, respectively, of said cooling fan in a manner to define the clearance at a radially outer portion between said disc-plate and said cooling fan.

* * * * *